United States Patent [19]

Bell

[11] 4,189,154

[45] Feb. 19, 1980

[54] WORD FORMING BOWLING GAME

[76] Inventor: Willard F. Bell, 1308 E. Church St., Stockton, Calif. 95205

[21] Appl. No.: 846,730

[22] Filed: Oct. 31, 1977

[51] Int. Cl.[2] ..... A63F 3/00

[52] U.S. Cl. ..... 273/272

[58] Field of Search ..... 273/272, 298, 299

[56] References Cited

U.S. PATENT DOCUMENTS

| | | | |
|---|---|---|---|
| 1,312,278 | 8/1919 | Shinn | 273/299 |
| 2,138,272 | 11/1938 | Feher | 273/298 |
| 2,681,804 | 6/1954 | Stover | 273/272 |
| 3,495,701 | 2/1970 | Chandos | 273/272 X |

FOREIGN PATENT DOCUMENTS

| | | | |
|---|---|---|---|
| 747598 | 4/1956 | United Kingdom | 273/272 |

*Primary Examiner*—Anton O. Oechsle
*Attorney, Agent, or Firm*—Howard I. Podell

[57] ABSTRACT

A game which comprises a game board having printed thereon the representation of two bowling lanes and of numbered ten pins. Also provided are cards bearing the representation of bowling pins with blacked-out circles corresponding to the bowling term expressed in the given card. Seventy lettered discs and four blank discs sized to be individually placed on the numbered ten pin representations on the game board are also provided. Each player randomly disposes ten of the discs face down on one of numbered arrays of ten pins. One of the players then draws a card and turns over those discs corresponding to the blacked-out circles on the drawn card with the object of then attempting to form a word using all of the thus exposed letters. A scoring system patterned after the game of bowling is employed.

3 Claims, 3 Drawing Figures

WORD FORMING BOWLING GAME

FIELD OF THE INVENTION

This invention relates generally to an educational game based on bowling.

STATEMENT OF PRIOR ART

The prior art, as exemplified by U.S. Pat. Nos. 2,835,053; 3,520,072; 3,195,893 and 3,077,677 is generally illustrative of various games of this type. While such devices are generally acceptable for their intended purpose they have not proven to be entirely satisfactory in that they are either complex and expensive to manufacture, or inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangements of parts which will be exemplified in the construction hereinafter described, and of which the scope of application will be indicated in the following claims.

SUMMARY OF THE INVENTION

This invention resides in a game which comprises a game board having printed thereon the representation of two bowling lanes and of numbered ten pins. Also provided are cards bearing the representation of bowling pins with blacked-out circles corresponding to the bowling term expressed in the given card. Seventy-four discs of which seventy are lettered and used to form words using all the letters exposed on the card.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figure 1:
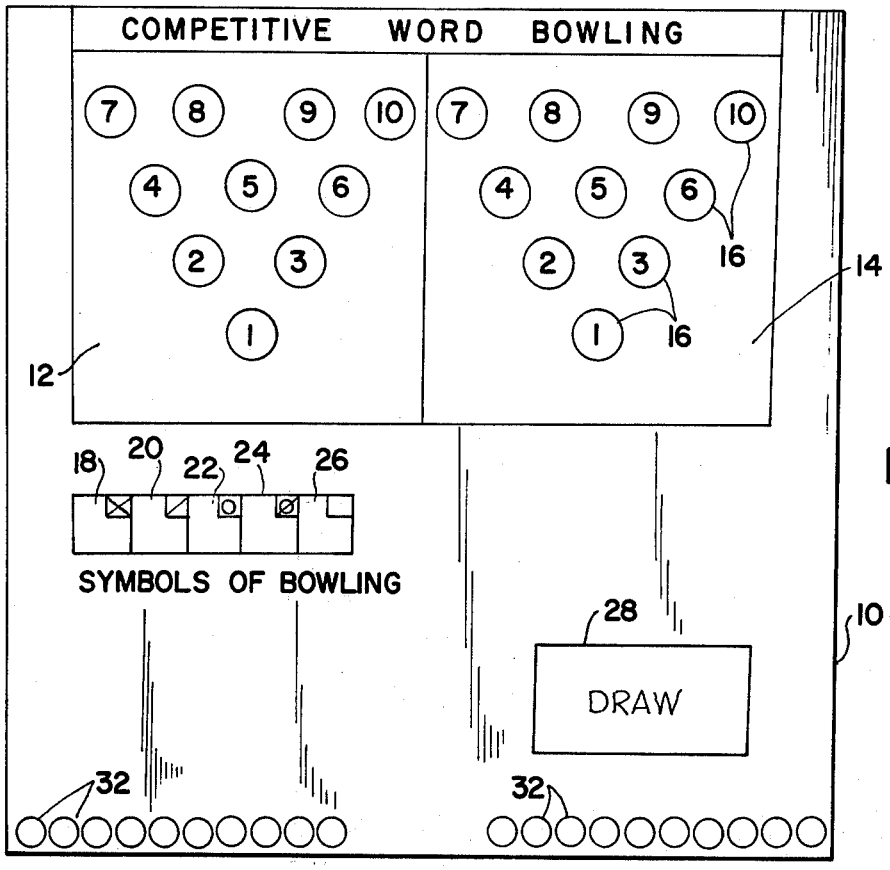
FIG. 1 is a top plan view of the game board.
Figure 2:
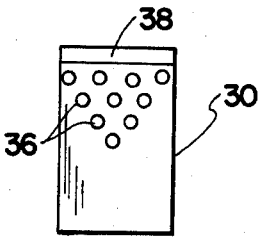
FIG. 2 is a top plan view of a playing card.
Figure 3:
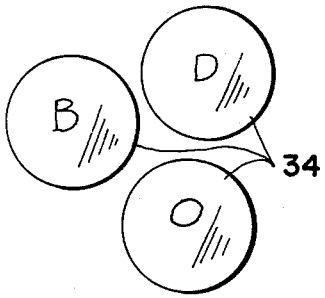
FIG. 3 is a top plan view of game pieces.

With reference to the drawing, there is shown and illustrated a game board of plastic or cardboard constructed in accordance with the principles of the invention and designated generally by reference character 10.

As shown in FIG. 1, the game board 10 has printed thereon adjoining representations of bowling lanes 12 and 14 (one lane for each player) with the emplacements of bowling pins denoted by circles 16 marked one to ten. Also printed on game board 10 are bowling symbols 18, 20, 22, 24 and 26. Provided also is an area marked "Draw" 28 on which cards 30 are placed face down during play. Ten circles 32 are located on each side of board 10 for placing thereon discs 34 when the players make their draw and attempt to form words. Game board 10 suitably is fifteen inches square and discs 34 are ¾ inch in diameter.

There are seventy-four discs 34, seventy of which are lettered and four which are blank. These discs are used in the game to form words as indicated by the cards 30. Each card has a different term or bowling expression written in its upper part 38 such as "Spare;" the card also will have blacked out circles to correspond to the pin arrangement defined by the term on area 38.

The number of discs on which a given letter appears is indicated below:

| | | | |
|---|---|---|---|
| A - 5 | I - 5 | Q - 1 | Y - 2 |
| B - 2 | J - 1 | R - 4 | Z - 1 |
| C - 2 | K - 1 | S - 4 | Blanks - 4 |
| D - 3 | L - 3 | T - 4 | |
| E - 6 | M - 2 | U - 2 | |
| F - 2 | N - 4 | V - 2 | |
| G - 2 | O - 5 | W - 2 | |
| H - 2 | P - 2 | X - 1 | |

After selecting their lane such as 12 or 14, the players turn all of the discs 34 face down and shuffle them.

The players then take the cards and shuffle them and place them face down on the designated area 28.

After it is determined who will start the game, all players write their names on a score pad in the order in which they will play.

After the above has been completed, each of the players will place ten discs, one to cover each numbered circle on the playing board, face down.

The next step will be to draw a card from the pile of cards and expose the letters of the discs corresponding to the blacked out areas on the card which has been drawn from the pile. Thus if the word "strike" is marked in box 38 of a card 30, all ten circles 36 of that card will be blacked out, and a player drawing such a card, will expose all of the ten discs 34 that he has previously placed on his section 12 or 14 of the board. He will be credited with a strike if he then forms a word with all ten letters of the ten discs. If a word is marked on box 38 that indicates, in bowling language, a particular configuration of lesser pins struck down, then that card will be marked with a black circle 36 corresponding to each struck down pin, and only those discs 34 on the corresponding position on the player's section 12 or 14 will be exposed for his use in forming a word. When the player forms a word using all of the letters of the exposed discs he is credited both with a strike score and an additional bonus corresponding to the number of discs 34 that were not exposed for that play.

The player must form a word using all of the exposed letters to get a strike. A bonus is given for the unexposed letters when a strike is scored.

However, when a player is unable to form a word with the exposed letters, he must then expose the remainder of the letters to form a ten letter word or two words using all ten exposed letters for a spare. If he is unable to do this, then he must form a word using as many letters as possible.

The score is to be recorded upon completion of each frame.

The advantages of this game are that it can teach one to become proficient in the method of scoring on bowling score sheets without having to suffer the embarassment of not knowing how when entering an alley for the first time. It can teach some of the terminology of the sport of bowling and will increase one's use of the dictionary for the spelling of certain words and thereby increase their vocabulary. Accordingly, the game can be used in the classroom.

It will thus be seen that there is provided a game in which the several objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. An educational word forming game for use by a plurality of players that is related to the game of bowling comprising a marked game board, a set of marked cards, and a set of playing pieces, in which the game board is marked with a representation of at least two bowling lanes sections, said marked representation including marked pin locations for each of ten individually numbered bowling pins on each bowling lane, in conventional bowling lane array, and each card of the set of marked cards is marked on a face side with a marked pin location for each of ten individual bowling pins that are oriented in similar respective position to the marked ten locations of bowling pins of a lane of the game board, with each of the said cards each individually marked to indicate that one or more of the said marked pin locations designates a location of a pin that has been struck as in a conventional game of bowling, and with each card marked with a title that describes a term in conventional bowling language that represents the configuration of the said designated locations when applied to the locations of pins that have been struck in a conventional game of bowling, and each playing piece is of a size to fit on an individual marked pin location on a bowling lane section of the game board, with an underside of each playing piece marked with an individual letter of the alphabet, with sufficient pieces so that all the letters of the alphabet are individually marked on separate playing pieces, such that a player may place in random order, an individual playing piece on each of the ten marked pin locations on a bowling lane with a marked letter on the underside of each playing piece concealed from view, and then select at random a said marked card so that the player, when viewing the face side of said marked card sees a title that describes in bowling language the configuration of the marked designated location of pins that have been struck in a conventional game of bowling, and so that the player may then expose the underside of each playing piece on his bowling lane section of the game board which occupies a said marked designated location on the card to view the letter of the alphabet marked on the underside of each said playing piece and so that said player may attempt to form a word using some or all of the said exposed letters of the alphabet.

2. The invention as recited in claim 1, comprising seventy-four game pieces.

3. The invention as recited in claim 1 together with additional playing pieces, the undersides of which are each marked as a blank.

* * * * *